United States Patent [19]

Dufour

[11] Patent Number: 4,790,083

[45] Date of Patent: Dec. 13, 1988

[54] GOLF SHOE

[75] Inventor: Pierre Dufour, Annecy, France

[73] Assignee: Salomon S.A., Metz-Tessy, France

[21] Appl. No.: 931,084

[22] Filed: Nov. 17, 1986

[30] Foreign Application Priority Data

Nov. 22, 1985 [FR] France ..... 85 17489

[51] Int. Cl.[4] ..... A43B 5/00

[52] U.S. Cl. ..... 36/127; 36/31

[58] Field of Search ..... 36/127, 31, 132, 133, 36/28, 103, 104; 128/584, 585

[56] References Cited

U.S. PATENT DOCUMENTS

| | | | |
|---|---|---|---|
| 1,870,751 | 8/1932 | Reach | 36/127 |
| 2,078,626 | 4/1937 | Bauer | 36/127 |
| 2,855,704 | 10/1958 | Schlesinger | 36/2.5 |
| 3,732,634 | 5/1973 | Jacobson | 36/127 |
| 4,094,081 | 6/1978 | Reiner et al. | 36/116 |
| 4,149,324 | 4/1979 | Lesser et al. | 36/127 |
| 4,161,829 | 7/1979 | Wayser | 36/127 |
| 4,180,924 | 1/1980 | Subotnick | 36/127 |
| 4,468,870 | 9/1984 | Sternberg | 36/127 |
| 4,506,462 | 3/1985 | Cavanagh | 36/31 |
| 4,524,531 | 6/1985 | Vanderipe | 36/127 |
| 4,547,979 | 10/1985 | Harada et al. | 36/31 |

FOREIGN PATENT DOCUMENTS

| | | |
|---|---|---|
| 0108278 | 5/1984 | European Pat. Off. . |
| 0126637 | 11/1984 | European Pat. Off. . |
| 2049394 | 12/1980 | United Kingdom . |

*Primary Examiner*—Steven N. Meyers

*Attorney, Agent, or Firm*—Sandler & Greenblum

[57] ABSTRACT

Shoe sole having a relatively inelastic portion, and at least one peripheral portion adapted to extend laterally beyond the insole of the shoe to which the sole is to be affixed. The lower surface of the sole has at least one edge which defines a pivot axis having a generally longitudinal orientation relative to the sole around which the foot of the wearer is adapted to pivot. The edge is positioned to be cushioned by a relatively elastic portion of the sole.

30 Claims, 4 Drawing Sheets

GOLF SHOE

BACKGROUND OF THE INVENTION

1. Field of the Invention

The present invention relaes to golf shoes and more particularly to soles for such shoes.

2. Description of Background and Relevant Materials

Golfing requires walking and body movements which are specific to the sport for hitting the golf ball with the club. These movements necessitate the proper setting of the feet of the golfer on the ground. The shoes utilized are relatively rigid, and are almost always of relatively simple design, and the support and the stability on the ground are generally assured by means of simple spikes which are embedded in the soles. This solution, by virtue of the nature of the specific positions and movements of the body and of the feet, is far from giving complete satisfaction.

Various attempts have been made to improve this situation which at present leave something to be desired. These attempts have been based upon an analysis of the positions and movements of the body and the feet which are necessary for good efficacy.

Thus, for better anchorage of the golfer's feet during the swing, when not walking, it has been proposed such as in U.S. Pat. No. 2,095,095, to provide removable spikes of which one portion can extend towards the front and on the exterior edge of the shoe to assure a better stability on the ground. Besides the fact that this solution is not very practical, it does not take into account the dynamic aspect of the transfer of weight from one foot to the other, and furthermore disturbs rotational relative movements of the feet during and after the address phase, the backswing phase, the downswing, hitting the ball, and the follow-through.

U.S. Pat. No. 3,195,891 proposes a configured removable corner for raising the exterior edge of the shoe (right for a right-handed golfer and vice versa for a left-handed golfer) and is interposed between the ground and the sole. The corner is secured to the sole by means of an elastic strap. Even if this solution, which is hardly more practical than the preceding one, can possibly improve the stability of the golfer's haunches during the address phase and facilitate the maintenance of a proper orientation of his body during the backswing phase and can even as is said, favor the efficacy of the downswing phase, it still does not take into account the movements involved in the subsequent phases. Yet, it is the subsequent phases which are of enormous significance for the efficacy of the hit and for these determinative phases, it is more the left foot (for a right handed golfer) which must preferably be raised on its exterior edge than the right as in this patent.

The insufficiency of the proposed embodiment of this patent appears to be noted by U.S. Pat. No. 2,847,769. However, this patent is interested only in a static position, i.e., the address position. In this position, the force lines of the weight of the golfer must preferably pass through the heels, the knees being flexed towards one another. Thus, symmetrical shoes have been proposed, to constrain the golfer to adopt a proper starting position, with configured soles whose thickness on the exterior edge is greater than that on the interior edge, this thickness decreasing from the front at the metatarsal support towards the heels to force the weight of the body to maintain itself thereon. As has previously been noted, this involves optimizing a static starting position without truly taking into account the following dynamic phases: backswing, downswing, impact and follow-through, which thus renders this solution more academic in character than realistic.

A more valuable contribution appears to have been proposed in U.S. Pat. No. 4,161,829 which attempts to account both for the comfort during walking of the golfer and the comfort during shooting. The soles of the shoes which have cutouts on the interior edge for the left foot and on the exterior edge for the right foot (for a right handed golfer) would not give a normal foot setting or even a supportable position during walking, over a distance on the order of a 7–8 kilometers which would result in the rapid and exaggerated fatigue of the user. However, the configurations utilized appear to add a support surface which is both stable and flexible to follow without impeding the displacements of the body of the golfer for directing the ball along the distance and orientation desired. During this movement which affects the impact and follow-through phases, the body undergoes the affect of the centrifugal force of the club and starts a displacement in the projection direction of the ball, the left knee (for a right handed golfer) displacing slightly towards the exterior and the left foot, thus pivoting on the exterior edge of the sole while the weight of the body passes almost entirely onto the left leg and the right heel lifts from the ground. The shoes are adapted to take into account these movements, and comprise for the left shoe: a sole without a support for the arch of the foot whose upper surface is thus planar, and in the plantar support zone a cut out corner of the interior side, and a lowered and rounded portion on the exterior side round which the shoe will pivot. For the right shoe there is an arch of the foot support sole, and in the zone of the tip of the foot an angled configuration in the lower corner on the exterior edge and raised on the interior edge which is itself rounded are provided. These shoes are in part at least contradictory with the those of the present state of the art which have been previously described such that even if they can effectively favor the impact and follow-through phases of the ball, nothing would appear to be able to absorb and stop the final pivoting phase on the exterior edge of the left foot. On the contrary, this pivoting possibility beyond that which is useful, is amplified by the rounded profile of this edge from where equilibrium conditions which are more and more unstable for the golfer at the end of this movement occur. Furthermore, as has been explained above, the seatings with very different inclination both in the longitudinal as well as transverse direction of the feet respectively, left and right, of the golfer render these shoes rather inappropriate for the walking phase which can be very long.

SUMMARY OF THE INVENTION

It is an object of the present invention to overcome the above disadvantages by restoring to the golfer normal and comfortable walking conditions, while nevertheless favoring the pivoting on the exterior edge of the left foot (for a right-handed golfer) as described above, but instead of amplifying, absorbing the pivoting at the end of its extent to facilitate the return to the equilibrium position.

According to the invention a shoe sole is provided having at least one peripheral portion adapted to extend laterally beond the insole of the shoe to which the sole is to be affixed, the lower surface of the sole having at least one edge which defines a pivot axis having a generally longitudinal orientation relative to the sole around which the foot of the wearer is adapted to pivot. The sole is specifically adapted fo use in the practice of golf.

The peripheral portion preferably extends in the longitudinal direction substantially from the metatarsal zone until the heel.

The edge may be a generally rectalinear exterior edge and extends along the exterior rim of the peripheral portion. Alternatively, the edge is a curved exterior edge extending along the exterior rim of the peripheral portion. The exterior edge comprising a plurality of contact points positioned to define the pivot axis.

The pivot axis may be oriented generally parallel to the nesting axis of the sole, or may converge or diverge relative to the nesting axis.

The edge may be adapted to define the axis to extend from within and beneath the outline of the insole to outside and beneath the outline of the insole. Alternatively, the edge is positioned on the exterior rim of the peripheral portion of the sole.

The peripheral portion comprises a thickened elastic material portion. This elastic portion may be of rectangular transverse cross-section. Alternatively, the thickened elastic material portion is of transverse triangular cross section, with the cross section increasing from the interior towards the exterior of the sole.

In yet another embodiment the peripheral portion is constituted by a rigid material having a bevel pointing towards the exterior of the sole with a wedge of elastic material being superimposed on this bevel.

In another embodiment the pivot axis is formed along a longitudinal groove provided in the lower surface of the sole, with at least one side forming the groove being interior of the exterior rim of the peripheral portion, and adapted to be beneath the insole. The peripheral edge comprises a thickened elastic portion.

Viewed from another perspective, the shoe sole of the invention has a relatively inelastic portion, and at least one peripheral portion adapted to extend laterally beyond the insole of the shoe to which the sole is to be affixed. The lower surface of th sole has at least one edge which defines a pivot axis having a generally longitudinal orientation relative to the sole around which the foot of the wearer is adapted to pivot. The edge is positioned to be cushioned by a relatively elastic portion of the shoe.

The sole is to be used in conjunction with a shoe upper and insole, most preferably in the context of a golf shoe.

The peripheral portion may be generally rectangular in cross section and be formed entirely of relatively elastic material, with the relatively elastic material extending over the relatively inelastic portion.

Alternatively, the peripheral portion is generally rectangular in cross section and is formed of a triangular cross sectional portion of relatively elastic material having a lower exterior edge along which the pivot axis extends.

In yet another embodiment the peripheral portion is generally curved in cross section in an inverted-U configuration and is formed entirely of relatively elastic material, with the relatively elastic material extending over the relatively inelastic material. The peripheral portion has an outer portion whose lower surface is positioned to be spaced above the ground, with the pivot axis extending along the interior lower surface of the sole.

According to another approach the peripheral portion comprises a relatively elastic wedge mating with a bevelled surface of the sole. The pivot axis is formed along an edge on a relatively inelastic portion comprising the bevelled surface, whereby the pivot edge is elastically cushioned by the elastic wedge.

BRIEF DESCRIPTION OF DRAWINGS

The invention will be better understood with reference to the annexed drawings given by way of non-limiting example only, with reference to the specification, in which.

DESCRIPTION OF PREFERRED EMBODIMENTS

In the description which follows, the shoe described is for the left foot of a right handed golfer. The transposition by simple symmetry is self-evident for the case of a left handed golfer. The right shoe, in the case which is of interest, does not form a part of the invention and may thus be of any conventional type.

Furthermore, the sole will be described with reference to the relatively flexible portion which constitutes a critical feature of the invention. The term "relatively flexible" is taken to refer generally to flexible materials, and more specifically to thermoplastic materials having a minimum shore hardness of 60 shore A, whereas the relatively inelastic material is preferably a thermoplastic material having a maximum hardness of 70 shore D. The relatively low elasticity portion of the sole is shown in the Figures without cross-hatching and requires little further discussion.

In the above discussion of the present state of the art, the importance of the pivoting movement of the left foot around its exterior edge during the impact and follow-through phases of the ball, have been described and it is not necessary to repeat them here in detail.

Figure 1:
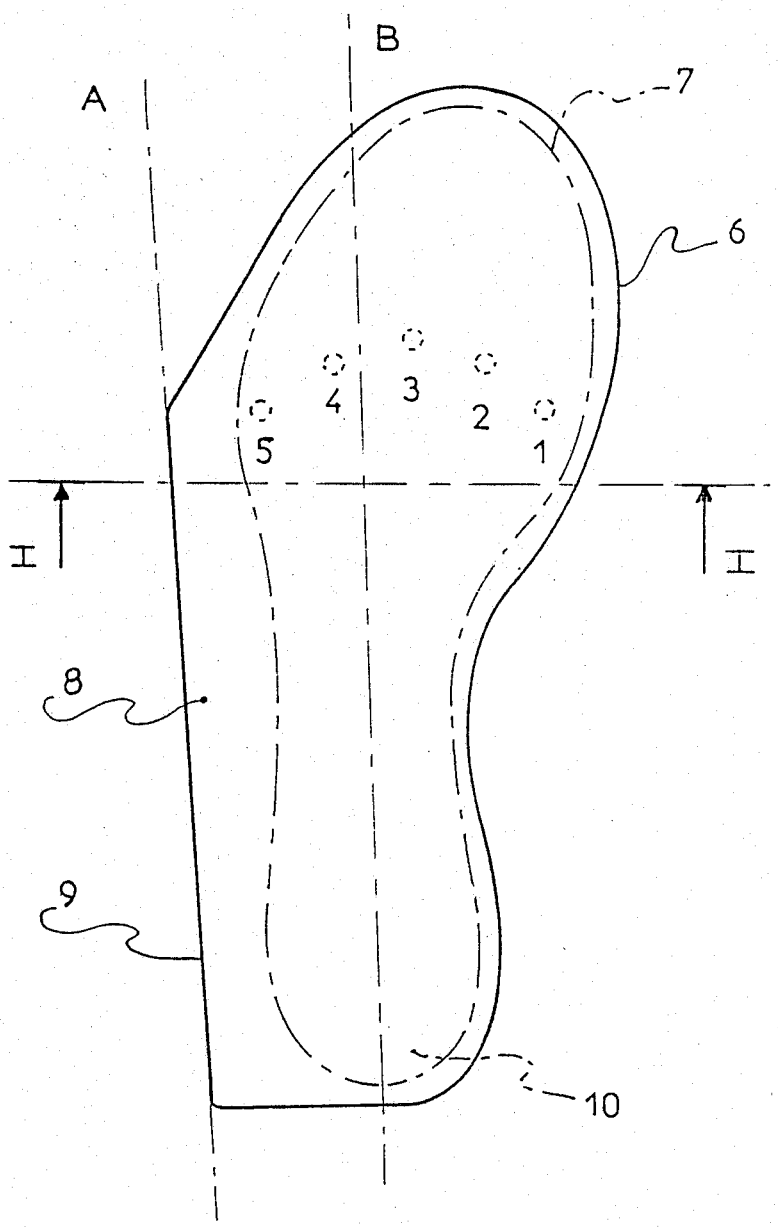
FIGS. 1–5 illustrate in planar view respectively different shoe sole shapes according to the invention.
Figure 2:
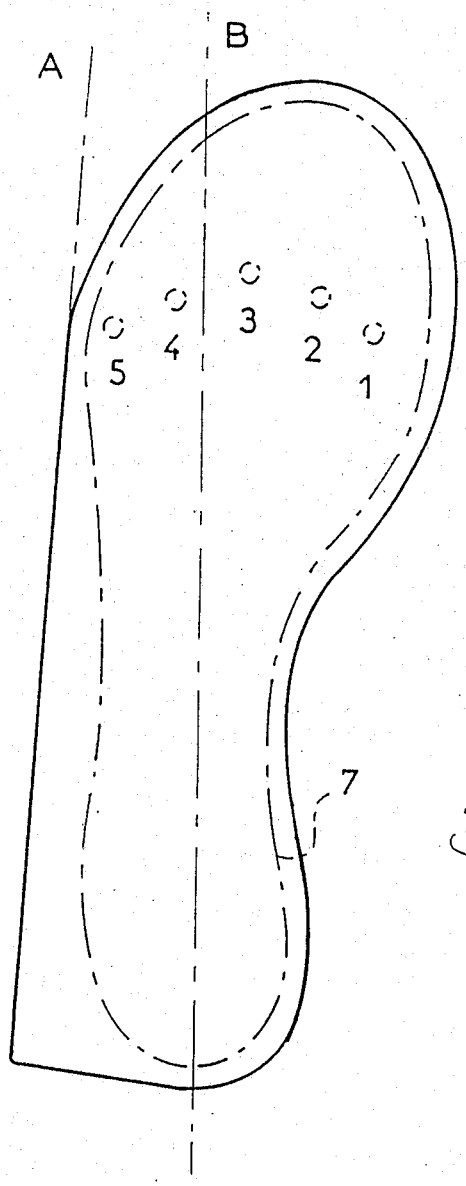
Figure 3:
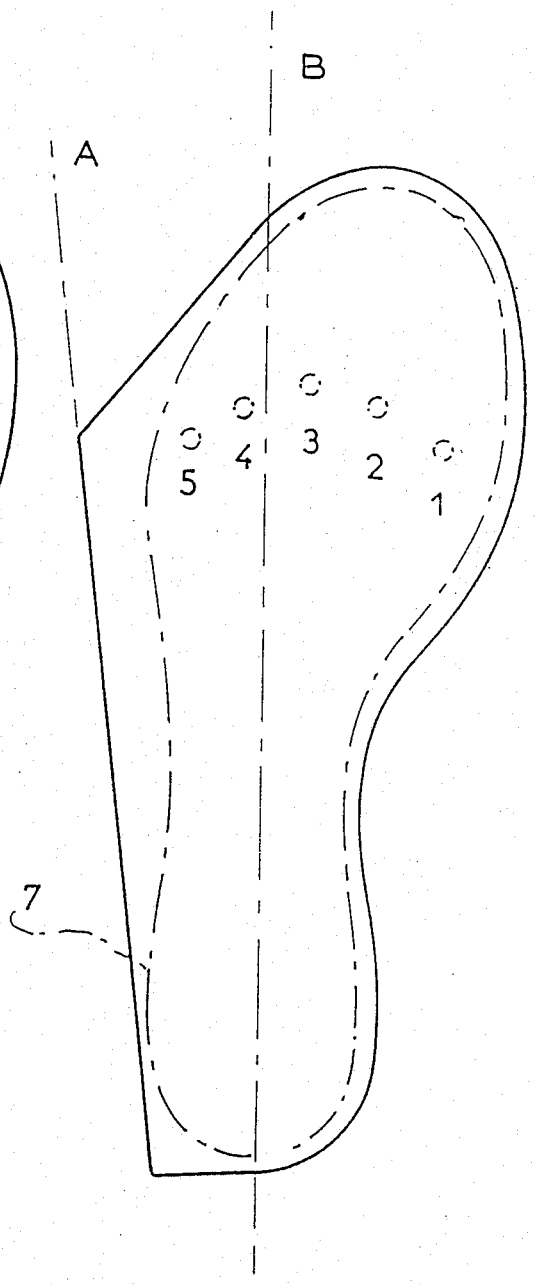

As may be seen in planar view in FIGS. 1–4, the shape of sole 6 according to a first embodiment of the invention is shown. Sole 6 extends beyond the interior side of the outline of the insole 7 in a conventional fashion, of which the nesting axis is referenced at B. So as to favor pivoting movement while at least continuing to assure good gripping of the golfer's foot of the ground, sole 6 extends at 8 beyond the exterior side to a greater extent the outline of the insole 7 to end in a rim 9 having on its lower side a projecting edge defining pivot axis A. Preferably, peripheral portion 8 will extend from directly beneath the 1–5 metatarsal zone and particularly at the level of the fifth metatarsal 5 until beneath heel 10. Rim 9 of peripheral portion 8 can be rectilinear as is illustrated in FIGS. 1–3 or, particularly for reasons of the choice of the golfer or for aesthetic reasons, have a curved shape as in FIG. 5, it being understood that only the convex portions necessitate the presence of a projection profile edge on their lower side.

Figure 4:
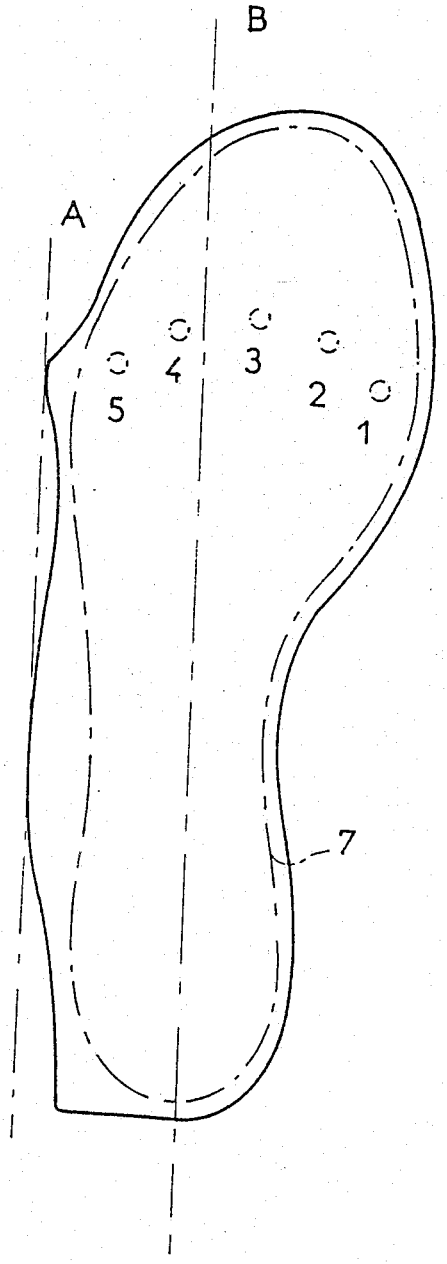

Furthermore, depending upon the preference, the habits and the degree of training of the golfer, pivot axis A can be either approximately parallel to the nesting axis B as in FIGS. 1 and 4, or converge, or diverge towards the front with respect to nesting axis B as in FIGS. 2 and 3, respectively.

Figure 5:
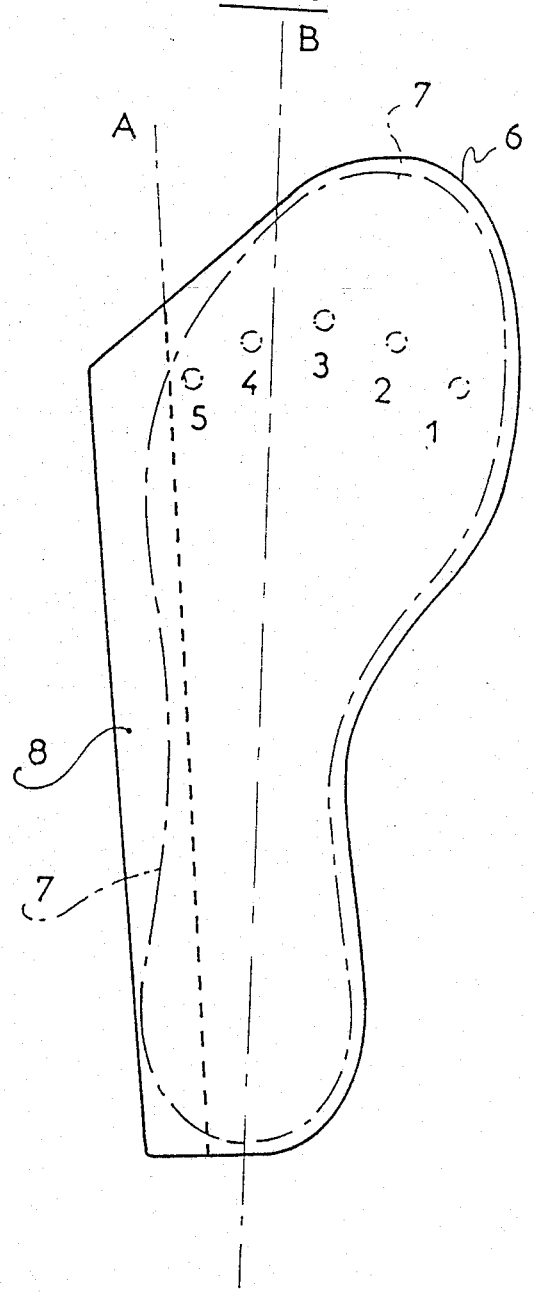
Figure 8:
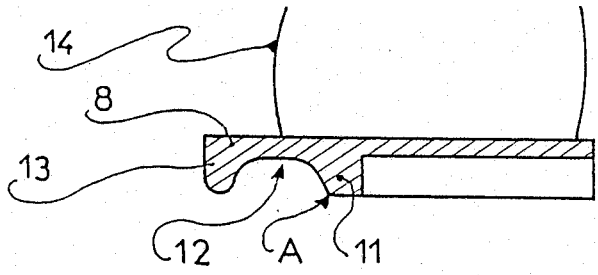

As in the embodiment of FIG. 5, pivot axis A need not be situated on the exterior rim of the surface defined by the contour of insole 7 but on the contrary may be much closer to nesting axis B to find itself under the foot of the golfer while still being in the vicinity of its exterior edge. In this case, the sole can have an edge, shown in dotted lines in FIG. 5, which extends from within and beneath the outline of the insole to outside and beneath the outline of the insole. Sole 6 can in transverse cross-section present itself as illustrated in FIG. 8, wherein a longitudinal groove 12 is provided in the lower surface of sole 6 making it possible to define a portion having a projecting edge 11 forming pivot axis A. Peripheral portion 8 continues to play its role of improving the gripping of the ground and the shock absorption, particularly at the end of the extent of the pivot movement. In all of the cases described above, it is desirable that the golfer, by virtue of the violent balancing movement of his body, accompanied by the pivoting of his foot around axis A, progressively and rapidly come back to equilibrium at the end of the follow-through phase. This result can be obtained by providing for pivoting against a progressive resistance until a final abutment position.

Figure 6:
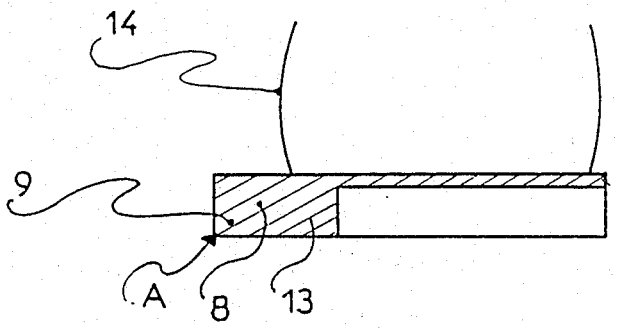
FIGS. 6–9 illustrate cross-sectional views according to planes corresponding to I—I of FIG. 1 of the soles according to the invention.
Figure 7:
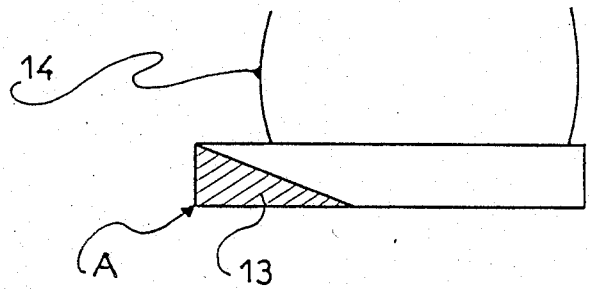

To this end, according to one supplemental aspect of the invention, the portions having projecting edges 9 and 11 defining the axis A are constituted by a thickness of elastic material 13, where necessary compressible, to give a progressively increasing absorption effect until reaching abutment. As illustrated in FIGS. 6–8, this thickness of elastic material (cross-hatched portion) can have different and even variable shapes along the zone being considered—the length of pivot axis A. Thus, in FIG. 6, the material has a rectangular cross-section which may be extended into a zone of lesser thickness passing under the foot of the golfer.

In FIG. 8 groove 12 has been provided between a raised peripheral rounded portion 13 and pivot axis A which contacts the ground.

Figure 9:
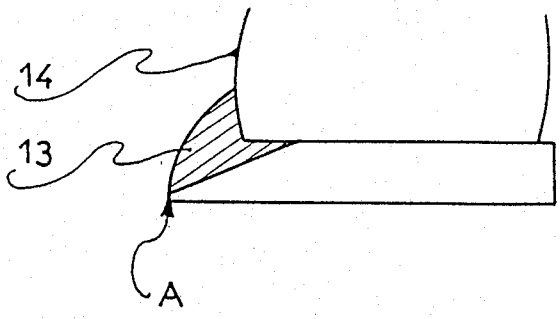

In the case of FIG. 9, pivot axis A is defined by a rigid portion of sole 6 which is shaped in a projecting bevel towards the exterior. The shock absorption function is assured by a corner wedge made of elastic material 13 covering the base of upper 14 and having a rounded convex profile bulging towards the exterior.

It is clear that other forms assuring the progressive shock absorption function and the terminal abutment function can be envisioned particularly as a function of the morphology and the desires of the golfer or further, as a function of the criteria of manufacture.

Although the invention has been described with reference to particular means, materials and embodiments, it is to be understood that the invention is not limited to the particulars disclosed in extents to all equivalents within the scope of the claims.

I claim:

1. A shoe sole for use with a shoe having an insole, said sole having an interior portion and an exterior and having at least one peripheral portion adapted to extend laterally beyond said insole of the shoe to which said sole is to be affixed, said sole having a lower surface, said lower surface of said sole having at least one edge which defines a pivot axis having a generally longitudinal orientation relative to said sole around which the foot of the wearer is adapted to pivot and wherein said peripheral portion comprises a thickened elastic material portion of transverse triangular cross-section, said cross-section increasing from said interior portion towards said exterior of the sole.

2. A shoe sole for use with a shoe having an insole, said sole having an exterior and having at least one peripheral portion adapted to extend laterally beyond said insole of the shoe to which said sole is to be affixed, said sole having a lower surface, said lower surface of said sole having at least one edge which defines a pivot axis having a generally longitudinal orientation relative to said sole around which the foot of the wearer is adapted to pivot wherein said peripheral portion is constituted by a rigid material having a bevel pointed towards said exterior of said sole and wherein a wedge of elastic material is superimposed on said bevel.

3. The shoe sole as defined by either of claims 1 and 2 wherein said peripheral portion comprises an exterior rim and wherein said edge is a generally rectilinear exterior edge and extends along said exterior rim of said peripheral portion.

4. The shoe sole as defined by either of claims 1 and 2 wherein said peripheral portion comprises an exterior rim and wherein said edge is a curved exterior edge extending along said exterior rim of the peripheral portion, said exterior edge comprising a plurality of contact points positioned to define said pivot axis.

5. The shoe sole as defined by either of claims 1 and 2 wherein said peripheral portion of said sole further comprises an exterior rim and wherein said edge is positioned on said exterior rim.

6. A shoe sole for use with a shoe having an insole, said sole having at least one peripheral portion adapted to extend laterally beyond said insole of the shoe to which said sole is to be affixed, said peripheral portion including an exterior rim, said sole having a lower surface, said lower surface of said sole having at least one edge which defines apivot axis having a generally longitudinal orientation relative to said sole around which the foot of the wearer is adapted to pivot wherein said pivot axis is formed along a longitudinal groove provided in said lower surface of said sole, with at least one side forming said groove being interior of said exterior rim of said peripheral portion and adapted to be beneath said insole.

7. The sole as defined by claim 6 wherein said peripheral edge comprises a thickened elastic portion.

8. The shoe sole as defined by claim 6 wherein said edge is adapted to define said axis to extend from within and beneath the outline of said insole to outside and beneath the outline of said insole.

9. The shoe sole as defined by any of claims 1, 2, and 6 wherein said sole is specifically adapted for use in the practice of golf.

10. The shoe sole as defined by any of claims 1, 2, and 6 wherein said peripheral portion extends in the longitudinal direction substantially from the metatarsal zone to the heel.

11. The shoe sole as defined by any of claims 1, 2, and 6 wherein said sole has a nesting axis and said pivot axis is oriented generally parallel to said nesting axis of said sole.

12. The shoe sole as defined by any of claims 1, 2, and 6 wherein said sole has a front end wherein said pivot axis converges towards the front with respect to said nesting axis of said sole.

13. The shoe sole as defined by any of claims 1, 2, and 6 wherein said sole has a front and wherein said pivot axis diverges towards said front with respect to said nesting axis of said sole.

14. The shoe sole as defined by any of claims 1, 2, and 6 wherein said peripheral portion comprises a thickened elastic material portion.

15. The shoe sole as defined by claim 14 wherein said thickened elastic material portion is of rectangular transverse cross-section.

16. A shoe sole for use with a shoe having an insole, said sole having a relatively inelastic portion, a lower surface, and at least one peripheral portion adapted to extend laterally beyond said insole of the shoe to which said sole is affixed, said peripheral portion including an exterior rim, said lower surface of said sole having at least one edge which defines a pivot axis having a generally longitudinal orientation relative to said sole around which the foot of the wearer is adapted to pivot, said edge being positioned to be cushioned by a relatively elastic material portion of said sole, wherein said pivot axis is formed by an interior edge interior of said exterior rim on said peripheral portion.

17. The shoe sole as defined by claim 16 wherein said interior edge is formed by a groove on the interior bottom surface of said sole.

18. A shoe sole for use with a shoe having an insole, said sole having a relatively inelastic portion, a lower surface, and at least one peripheral portion adapted to extend laterally beyond said insole of the shoe to which said sole is to be affixed, a lower surface, said lower surface of said sole having at least one edge which defines a pivot axis having a generally longitudinal orientation relative to said sole around which the foot of the wearer is adapted to pivot, said edge being positioned to be cushioned by a relatively elastic material portion of said sole, wherein said peripheral portion is generally rectangular in cross section and is formed entirely of said relatively elastic material, with said relatively elastic material extending over said relatively inelastic portion.

19. A shoe sole for use with a shoe having an insole, said sole having a relatively inelastic portion, a lower surface, and at least one peripheral portion adapted to extend laterally beyond said insole of the shoe to which said sole is to be affixed, said lower surface of said sole having at least one edge which defines a pivot axis having a generally longitudinal orientation relative to said sole around which the foot of the wearer is adapted to pivot, said edge positioned to be cushioned by a relatively elastic material portion of said sole, wherein said peripheral portion is generally rectangularin cross section and is formed of a triangular cross sectional portion of said relatively elastic material having a lower exterior edge along which said pivot axis extends.

20. A shoe sole for use with a shoe having an insole, said sole having a relatively inelastic portion, a lower surface, and at least one peripheral portion adapted to extend laterally beyond said insole of the shoe to which said sole is to be affixed, said lower surface of said sole having at least one edge which defines a pivot axis having a generally longitudinal orientation relative to said sole around which the foot of the wearer is adapted to pivot, said edge being positioned to be cushioned by a relatively elastic material portion of said sole, wherein said peripheral portion is generally curved in cross section in an inverted-U configuration and is formed entirely of said relatively elastic material, with said relatively elastic material extending over said relatively inelastic portion.

21. The shoe sole as defined by claim 20 wherein said peripheral portion has an outer portion whose lower surface is positioned to be spaced above the ground, with said pivot axis extending along the interior lower surface of said sole.

22. A shoe sole for use with a shoe having an insole, said sole having a relatively inelastic portion, a lower surface, and at least one peripheral portion adapted to extend laterally beyond said insole of the said shoe to which said sole is to be affixed, said lower surface of said sole having at least one edge which defines a pivot axis having a generally longitudinal orientation relative to said sole around which the foot of the wearer is adapted to pivot, said edge being positioned to be cushioned by a relatively elastic material portion of said sole, wherein said peripheral portion comprises a relatively elatic wedge mating with a bevelled surface of said sole, said pivot axis being formed along an edge on a relatively inelastic portion comprising said bevelled surface, whereby said pivot edge is elastically cushioned by said elastic wedge.

23. A shoe comprising the shoe sole as defined by any of claims 16, 18, 19, 20, and 22 in combination with a shoe upper and insole.

24. The shoe as defined by claim 23 wherein said shoe is a golf shoe.

25. The shoe sole as defined by any of claims 16, 18, 19, 20, and 22 wherein said pivot axis is oriented generally parallel to a nesting axis of said shoe onto which said sole is to be attached.

26. The shoe sole as defined by any of claims 16, 18, 19, 20, and 22 wherein said pivot axis is oriented to generally converge in the forward direction with a nesting axis of said shoe onto which said sole is to be attached.

27. The shoe sole as defined by any of claims 16, 18, 19, 20, and 22 wherein said pivot axis is oriented to generally diverge in the forward direction with a nesting axis of said shoe onto which said sole is to be attached.

28. The shoe sole as defined by either of claims 18, 19, and 22 wherein said peripheral portion comprises an exterior rim having an exterior edge and wherein said pivot axis is formed by said exterior edge of said exterior rim of said peripheral portion.

29. The shoe sole as defined by claim 28 wherein said exterior edge is linear.

30. The shoe sole as defined by claim 28 wherein said exterior edge is curved to form said pivot axis.

* * * * *